US005441242A

United States Patent [19]

Ebner

[11] Patent Number: 5,441,242

[45] Date of Patent: Aug. 15, 1995

[54] APPARATUS FOR CONTACTING SURFACES OF WORKPIECES WITH A FLOWING GAS

[75] Inventor: Peter Ebner, Leonding, Austria

[73] Assignee: Ebner Industrieofenbau Gesellschaft m.b.H., Leonding, Austria

[21] Appl. No.: 159,805

[22] Filed: Nov. 30, 1993

[30] Foreign Application Priority Data

Dec. 4, 1992 [AU] Australia ..... A2395/92

[51] Int. Cl.[6] ..... F26B 9/06

[52] U.S. Cl. ..... 266/251; 266/252; 148/601

[58] Field of Search ..... 266/251, 252, 102, 103; 148/601

[56] References Cited

U.S. PATENT DOCUMENTS 4,736,529 4/1988 Kramer ..... 266/251
4,817,920 4/1989 Erfort, Jr. ..... 266/252

FOREIGN PATENT DOCUMENTS 388391 3/1983 Austria .
0189855 8/1986 European Pat. Off. .

*Primary Examiner*—Scott Kastler
*Attorney, Agent, or Firm*—Collard & Roe

[57] ABSTRACT

An apparatus is disclosed, which serves to contact with a flowing gas two mutually opposite, substantially flat and substantially circular annular surfaces of an annular cylindrical workpiece having an inside diameter not in excess of a predetermined maximum inside diameter. The apparatus comprises an oven housing, which contains two mutually opposite plenum chambers, which are defined by respective side walls which are spaced apart in an axial direction and define between them an oven chamber adapted to accommodate said workpiece in a position in which each of said side walls faces one of said surfaces of said workpiece, each of said side walls being formed with orifice slot means, and a fan for supplying a gas to said plenum chambers. In order to ensure that the said surfaces of said workpiece will be uniformly supplied with said gas, said orifice slot means in each of said side walls consist of a circular annular slot, which is concentric to said circular annular slot in the other of said side walls, and the inside diameter of each of said circular annular slots exceeds the inside diameter of said annular workpiece, whereby said annular workpiece is adapted to be positioned in said oven chamber in a position in which said circular annular slots are concentric to said substantially circular surfaces of said workpiece.

3 Claims, 4 Drawing Sheets

APPARATUS FOR CONTACTING SURFACES OF WORKPIECES WITH A FLOWING GAS

BACKGROUND OF THE INVENTION

1. Field of the Invention

This invention relates to an apparatus for contacting with a flowing gas two mutually opposite, substantially flat and substantially circular annular surfaces of annular cylindrical workpiece having an inside diameter not in excess of a predetermined maximum inside diameter, which apparatus comprises an oven housing, which contains two mutually opposite plenum chambers, which are defined by respective side walls, which are spaced apart in an axial direction and define between them an oven chamber adapted to accommodate said workpiece in a position in which each of said side walls faces one of said surfaces of said workpiece, each of said side walls being formed with orifice slot means, and means for supplying a gas to said plenum chambers. In particular the invention relates to an apparatus for contacting with a flowing gas two mutually opposite, substantially flat and substantially circular annular end faces of an annular cylindrical workpiece consisting of a strip coil, which is provided with a tubular core having an outside diameter which defines the inside diameter of said strip coil.

2. Description of the Prior Art

In such apparatuses the flowing gas is usually employed to transfer heat to a workpiece, particularly to a strip coil, and it is desired to ensure a uniform supply of the flowing gas to the substantially flat surfaces of the workpiece so that a uniform heat transfer and optionally also a uniform mass transfer between the flowing gas and the surfaces of the workpiece is ensured because otherwise the workpiece may not be uniformly heated and the surface of the strip coil may exhibit a non-uniform color change. Said risks will be particularly high if a high heat transfer rate is desired in order to shorten the annealing time.

U.S. Pat. No. 4,736,529 discloses an apparatus which has on each side a plurality of orifice slots, which extend radially at least approximately in a plane and through which gas streams are discharged in a direction which is inclined relative to the side wall which is formed with said slots and defines a plenum chamber so that the gas is uniformly supplied to the surfaces of the workpiece. But it has been found that the desired result is not satisfactorily produced because only a very small part of the heat content of the gas which is discharged through the radially outer end portions of the orifices is transferred to the workpiece and said gas is mixed with gas which has transferred heat to the end face of the coil or to the surface of another workpiece but can still compensate the heat losses of the gas which is discharged near the periphery of the coil or other workpiece so that the coil or other workpiece is heated to higher temperature in regions of its peripheral surface.

SUMMARY OF THE INVENTION

It is an object of the invention so to improve with simple means an apparatus of the kind described first hereinbefore that a substantially uniform supply of gas to the workpiece surfaces or the coil end faces is actually ensured.

That object is accomplished in accordance with the invention in that the orifice slot means consist of circular rings, which are substantially concentric with the cylindrical surfaces or substantially coaxial to the strip coil and the inside diameter of the orifice slots exceeds the outside diameter of the tubular core of the coil.

Specifically, said orifice slot means in each of said side walls consist of a circular annular slot, which is concentric to said circular annular slot in the other of said side walls, and inside diameter of each of said circular annular slots exceeds the inside diameter of said annular workpiece, whereby said annular workpiece is adapted to be positioned in said annular workpiece is adapted to be positioned in said oven chamber in a position in which said circular annular slots are concentric to said substantially circular surfaces of said workpiece.

Because the velocity of flow of the gas on the end face of the coil necessarily decreases in an radially outward direction, those outer portions of the workpieces or strip coils which assume higher temperatures in the operation of the previously known apparatuses are now contacted by a flowing gas which after its discharge from the annular slot is mainly deflected toward the outer portions of the workpiece or coil and as it is deflected transfers heat to the end face of the coil but is not mixed with hot gas at radially outer portions of the workpiece or coil. As a result, the peripheral portions of the workpiece are heated to lower temperatures than in the known apparatuses and a local overheating is thus avoided.

According to a further feature of the invention each side wall which is formed with said annular slot comprises an inner part, which defines the inner edge of the annular slot and is mounted to be adjustable in said axial direction relative to the remainder of said side wall so that the inclination of the stream of gas directed toward the workpiece can be adjusted as desired.

Unfavorable heating influences may be caused by asymmetries of the fan and may be compensated in that the inner part of each side wall, which inner edge defines the inner edge of the orifice, is mounted to be adjustable at right angles to said axial direction so that the annular slot has a varying radial width and an even closer adaptation to a given design is permitted.

Finally, swirling and/or guiding vanes may be provided in the annular slots in order to achieve a desirable flow pattern of the gas in the annular slot.

DETAILED DESCRIPTION OF THE PREFERRED EMBODIMENTS

Illustrative embodiments will now be described more in detail with reference to the strictly schematic drawing.

Figure 1:
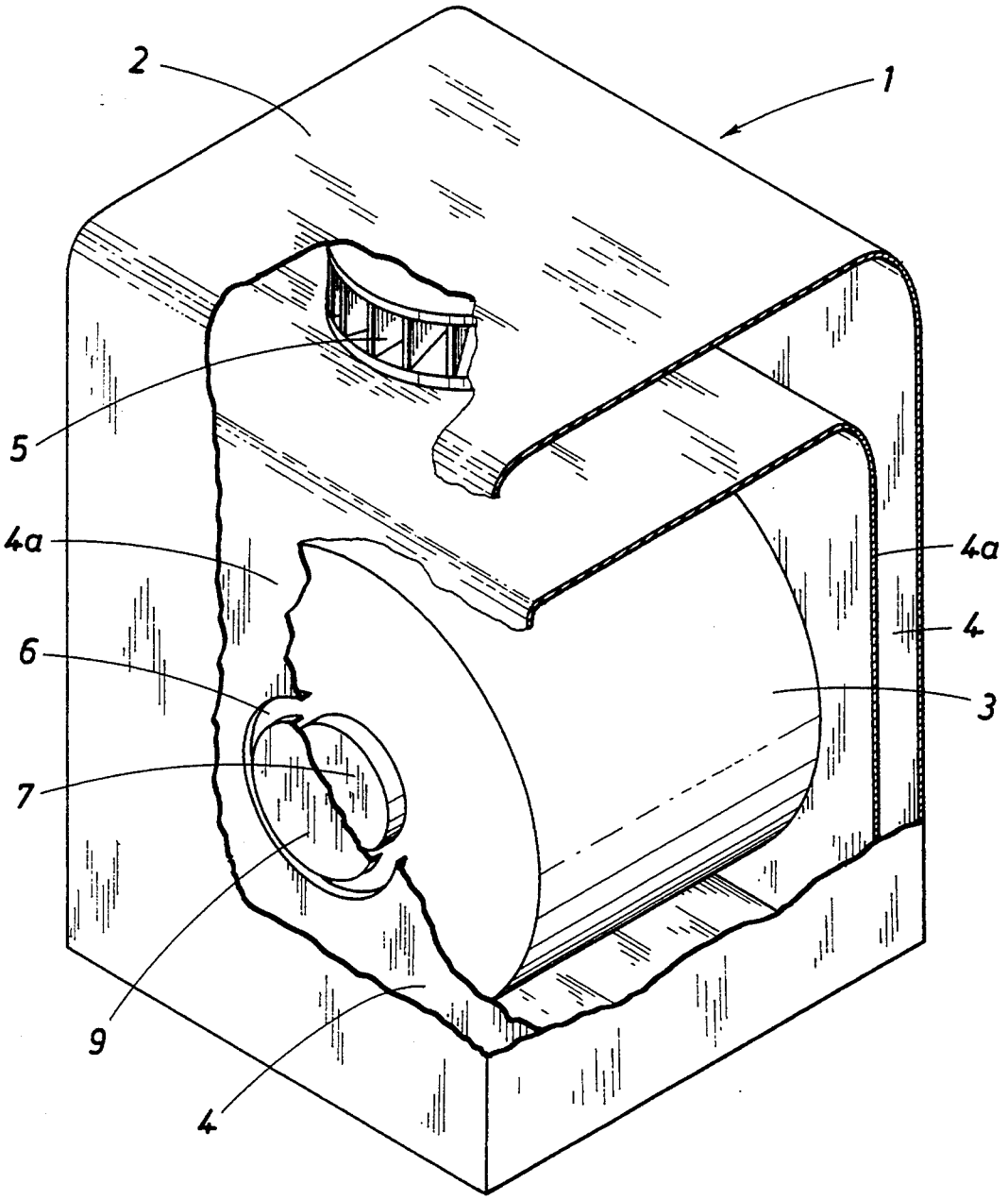
FIG. 1 is a perspective view, which is partly broken up and shows an apparatus embodying the invention and comprising an oven.
Figure 2:
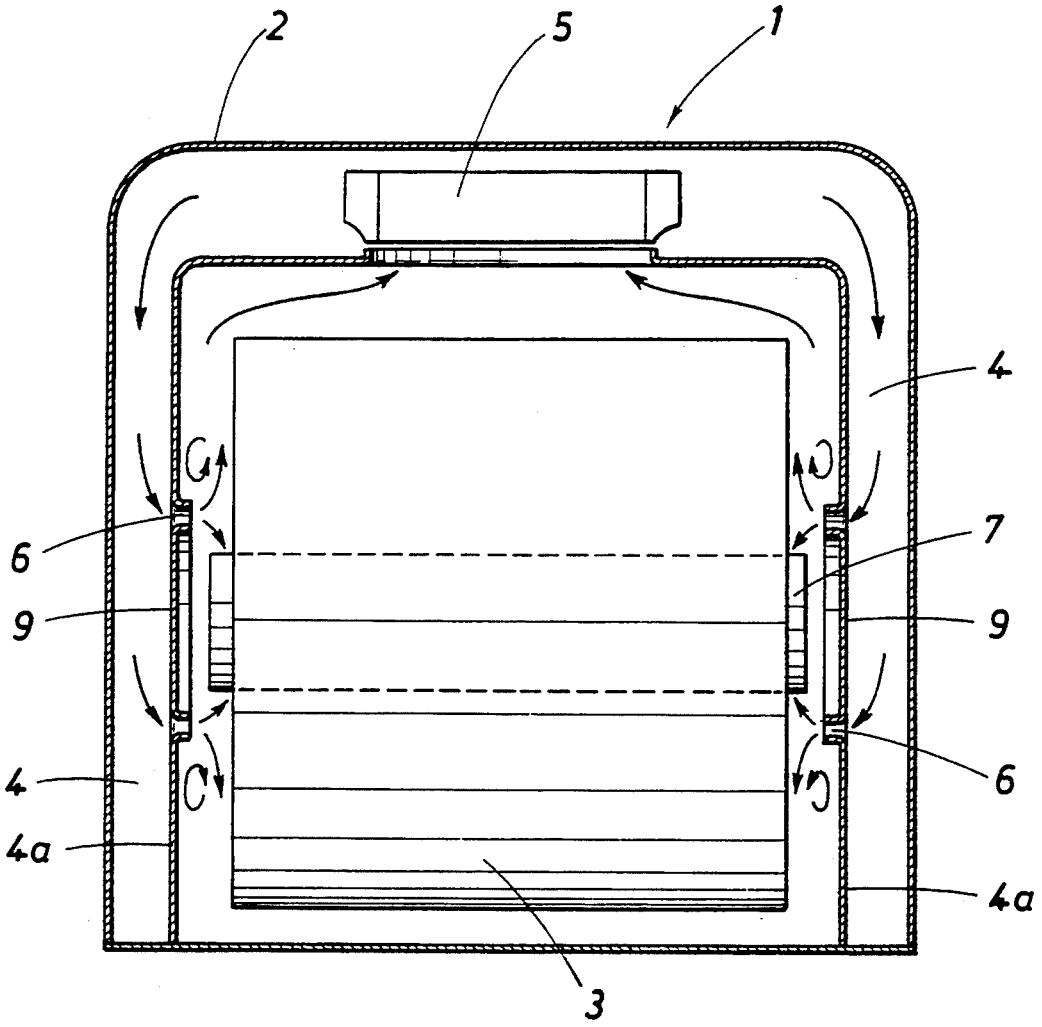
FIGS. 2, 3, 4 and 5 are vertical sectional views showing various embodiments of those parts of such an apparatus which are essential for the invention.

With reference to FIGS. 1 and 2, an oven 1 comprises a substantially closed housing 2, which has a door, not shown, through which circular cylindrical annular workpieces consisting of strip coils 3 can be introduced into and removed from the housing 2. The housing 2 contains mutually opposite plenum chambers 4, which are supplied by a fan 5 with a gas, which has been heated by heating means, not shown. In the housing 2, the strip coil 3 is supported in the usual manner by a coil holder, not shown.

The plenum chambers 4 are associated with respective end faces of the strip coil 3 and are defined by side walls 4*a*, which are spaced apart in the axial direction of the strip coil 3. The side walls face respective end faces of the strip coil 3 and define circular annular slots 6, which are concentric to the strip coil 3 and to its end faces. The inside diameter of each annular slot 6 exceeds the outside diameter of the tubular core 7 of the coil, i.e., the inside diameter of the coil. The gas delivered by the fan 6 flows through the annular slot 6 toward the adjacent end face of the strip coil 3 and flows radially outwardly over said end face.

The housing 2 may contain a plurality of coaxial oven chambers for receiving respective strip coils, provided that two axially spaced apart plenum chambers 4 must be provided on opposite sides of each of said oven chambers and adjacent plenum chambers 4 must be separated by a partition.

Figure 3:
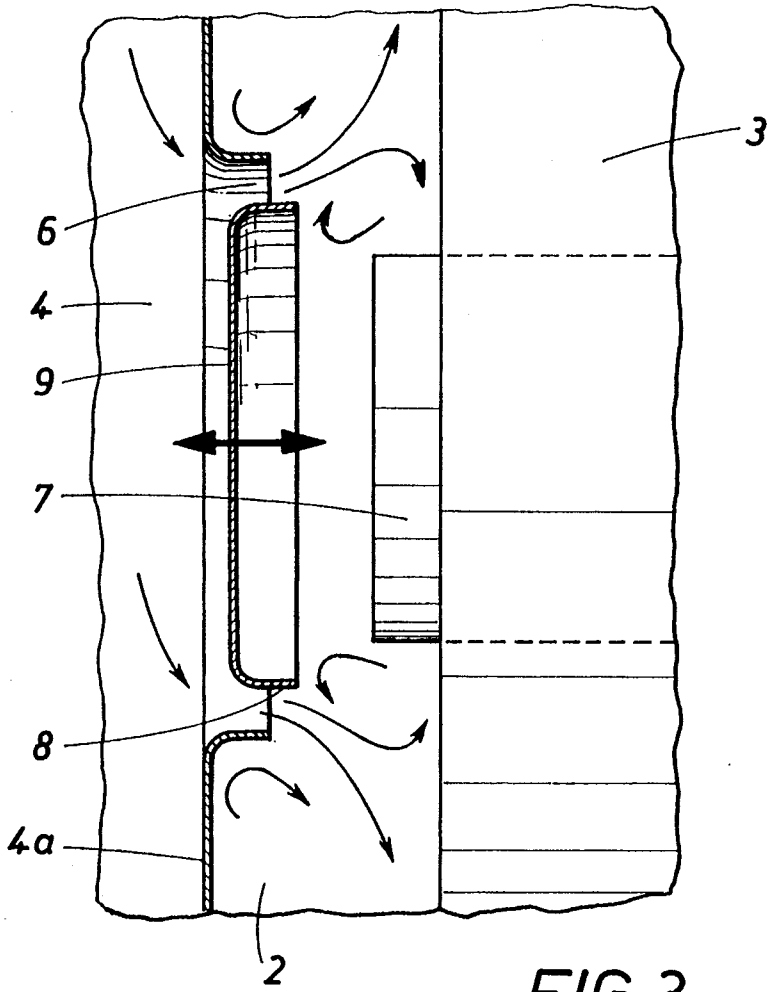

In the embodiment shown in FIG. 3 each side wall 4*a* formed with an annular slot 6 comprises an inner part 9, which defines the inner edge 8 of the orifice 6 and is mounted to be adjustable in the axial direction of the strip coil 3 relative to the remainder of the side walls 4*a*.

Figure 4:
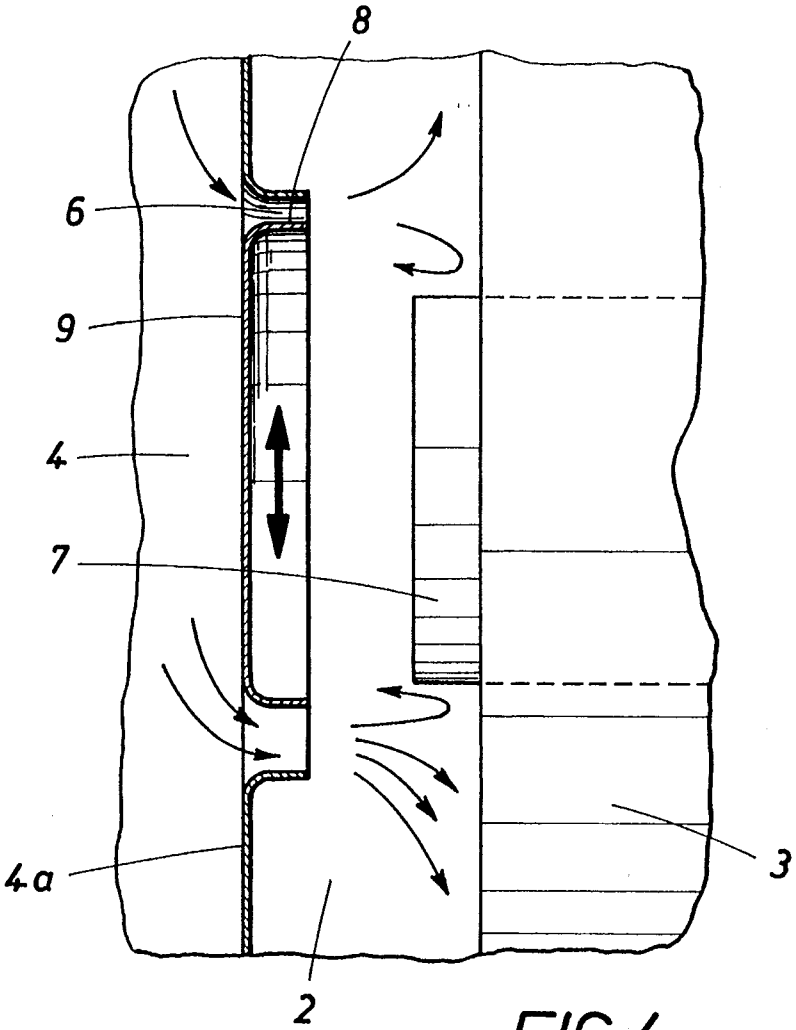

In the embodiment shown in FIG. 4, said inner part 9 is mounted to be adjustable relative to the remainder of the side wall 4*a* in a direction which is normal to the axial direction of the strip coil 3.

Figure 6:
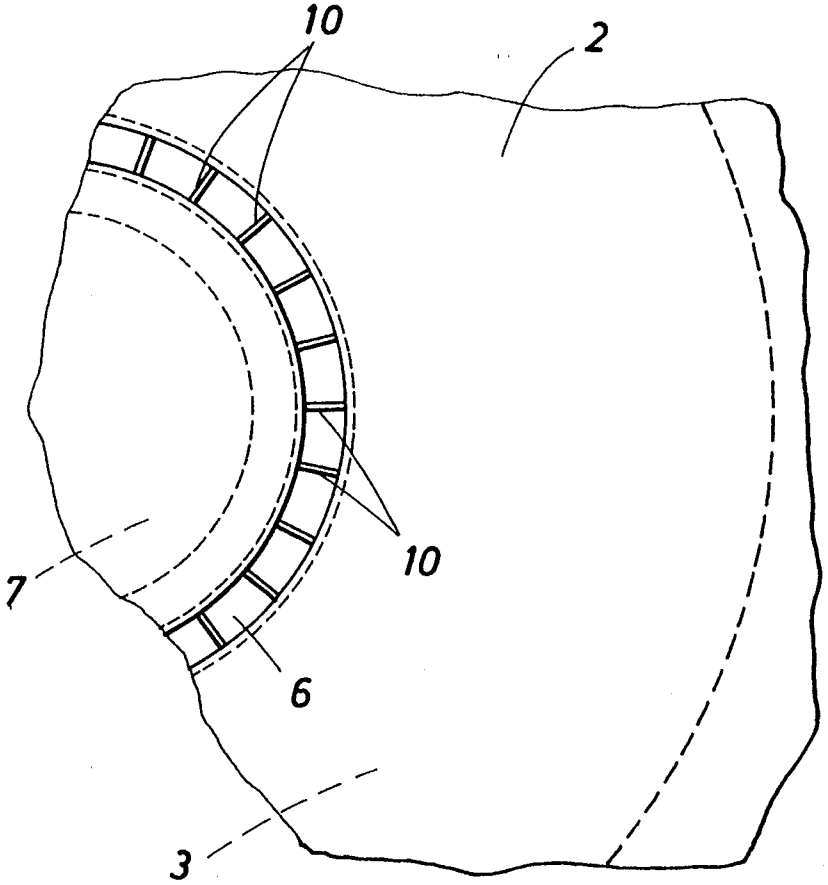
FIG. 6 is an end elevation showing the embodiment of FIG. 5.
Figure 5:
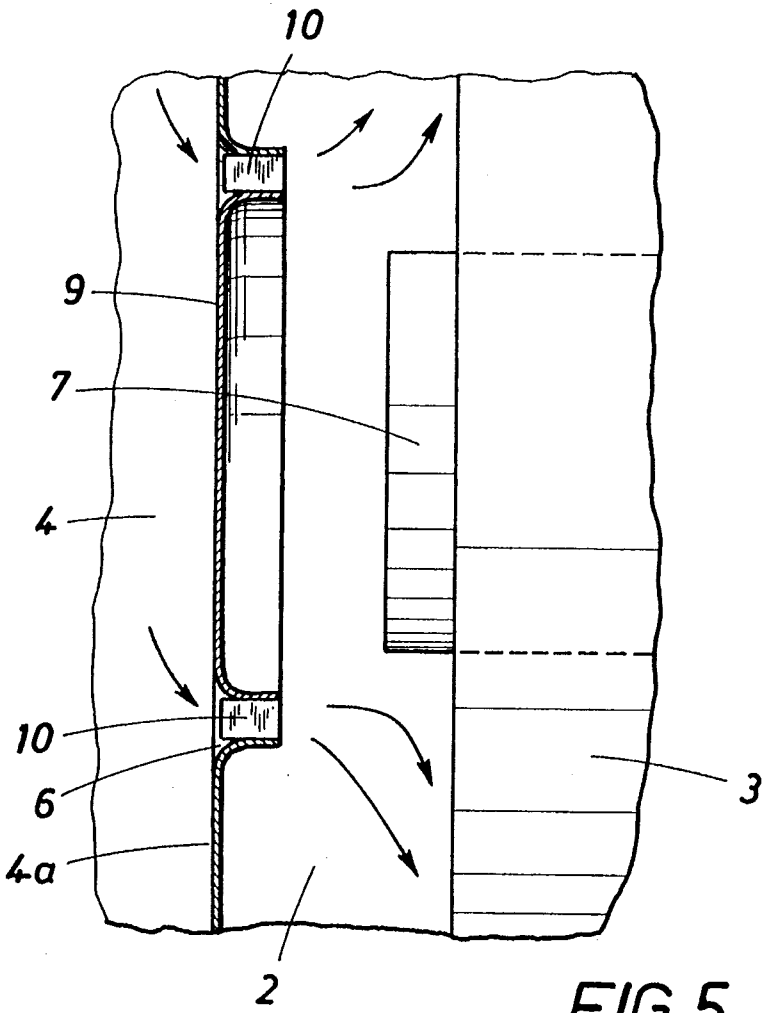

In the embodiment shown in FIGS. 5 and 6, flow-directing means consisting of swirling or guiding vanes 10 are provided in each annular slot 6 in order to produce a swirling gas stream, which is directed to the adjacent end face of the strip coil 3 at an inclination to said end face.

The directions of flow of the gas are indicated by arrows.

I claim:

1. An apparatus for contacting with a flowing gas two opposite, substantially flat annular end faces of a cylindrical strip coil wound on a core having a diameter defining an inside diameter of the strip coil, the strip coil wound on the core being mounted in an oven housing defining with respective side walls spaced from the end faces two opposite plenum chambers receiving the flowing gas, and the side walls defining annular slots concentrically surrounding the core and substantially coaxial therewith, the annular slots having an inner diameter exceeding the core diameter and the inside diameter of the strip coil, and each of said side walls comprising an inner part which defines an inner edge of the annular slot of each side wall and is mounted to be adjustable in the axial direction relative to the remainder of said side wall.

2. An apparatus for contacting with a flowing gas two opposite, substantially flat annular end faces of a cylindrical strip coil wound on a core having a diameter defining an inside diameter of the strip coil, the strip coil wound on the core being mounted in an oven housing defining with respective side walls spaced from the end faces two opposite plenum chambers receiving the flowing gas, and the side walls defining annular slots concentrically surrounding the core and substantially coaxial therewith, the annular slots having an inner diameter exceeding the core diameter and the inside diameter of the strip coil, and each of said side walls comprising an inner part which defines an inner edge of the annular slot of each side wall and is mounted to be adjustable in a direction which is normal to the axial direction relative to the remainder of said side wall.

3. An apparatus for contacting with a flowing gas two opposite, substantially flat annular end faces of a cylindrical strip coil wound on a core having a diameter defining an inside diameter of the strip coil, the strip coil wound on the core being mounted in an oven housing defining with respective side walls spaced from the end faces two opposite plenum chambers receiving the flowing gas, and the side walls defining annular slots concentrically surrounding the core and substantially coaxial therewith, the annular slots having an inner diameter exceeding the core diameter and the inside diameter of the strip coil, and each of said side walls comprising an inner part which defines an inner edge of the annular slot of each side wall and is mounted to be adjustable in the axial direction and in a direction which is normal to the axial direction relative to the remainder of said side wall.

* * * * *

UNITED STATES PATENT AND TRADEMARK OFFICE

CERTIFICATE OF CORRECTION

PATENT NO. : 5,441,242

DATED : AUGUST 15, 1995

INVENTOR(S) : PETER EBNER

It is certified that error appears in the above-identified patent and that said Letters Patent is hereby corrected as shown below:

Title page, item (30), "Australia" should be --Austria--.

Signed and Sealed this

Twenty-first Day of November, 1995

*Attest:*

*Attesting Officer*

BRUCE LEHMAN

*Commissioner of Patents and Trademarks*